US009335091B2

(12) United States Patent
Qualls et al.

(10) Patent No.: US 9,335,091 B2
(45) Date of Patent: May 10, 2016

(54) NITROGEN REJECTION UNIT

(71) Applicant: CONOCOPHILLIPS COMPANY, Houston, TX (US)

(72) Inventors: Wesley Roy Qualls, Katy, TX (US); Qi Ma, Katy, TX (US); Megan Victoria Evans, Houston, TX (US); Karl Lee Herzog, Houston, TX (US); Jame Yao, Sugar Land, TX (US); Mohan Chahal, Houston, TX (US); Matt Calvin Gentry, Katy, TX (US); Attilio Jose Praderio, Humble, TX (US); Marc Thomas Bellomy, Cypress, TX (US); Satish Gandhi, Sugar Land, TX (US); Mike Wilkes, Katy, TX (US); Will James, Richmond, TX (US)

(73) Assignee: ConocoPhillips Company, Houston, TX (US)

( * ) Notice: Subject to any disclaimer, the term of this patent is extended or adjusted under 35 U.S.C. 154(b) by 358 days.

(21) Appl. No.: 13/951,021

(22) Filed: Jul. 25, 2013

(65) Prior Publication Data

US 2014/0238076 A1 Aug. 28, 2014

Related U.S. Application Data

(60) Provisional application No. 61/770,481, filed on Feb. 28, 2013.

(51) Int. Cl.

| | |
|---|---|
| ***F25J 1/00*** | (2006.01) |
| ***F25J 3/00*** | (2006.01) |
| ***F25J 1/02*** | (2006.01) |
| ***F25J 3/02*** | (2006.01) |

(52) U.S. Cl.

CPC ..... *F25J 1/0022* (2013.01); *F25J 1/004* (2013.01); *F25J 1/0045* (2013.01); *F25J 1/0052* (2013.01); *F25J 1/0082* (2013.01); *F25J 1/0085* (2013.01); *F25J 1/0087* (2013.01); *F25J 1/021* (2013.01); *F25J 1/0209* (2013.01); *F25J 1/0217* (2013.01); *F25J 1/0238* (2013.01); *F25J 1/0245* (2013.01); *F25J 3/0209* (2013.01); *F25J 3/0233* (2013.01); *F25J 3/0257* (2013.01); *F25J 2200/08* (2013.01); *F25J 2200/40* (2013.01); *F25J 2200/70* (2013.01); *F25J 2200/76* (2013.01); *F25J 2215/60* (2013.01); *F25J 2220/64* (2013.01); *F25J 2245/42* (2013.01); *F25J 2270/02* (2013.01); *F25J 2270/42* (2013.01)

(58) Field of Classification Search

CPC ..... F25J 3/0257; F25J 3/0209; F25J 3/0233; F25J 3/04448; F25J 1/021; F25J 1/0022; F25J 1/0045; F25J 1/0052; F25J 1/0082; F25J 1/0085; F25J 1/0087; F25J 2270/42; F25J 2200/40; F25J 2215/042; F25J 2215/60; F25J 2200/08

See application file for complete search history.

(56) References Cited

U.S. PATENT DOCUMENTS

| | | | | |
|---|---|---|---|---|
| 4,225,329 A * | 9/1980 | Bailey | F25J 1/0022 | 62/623 |
| 6,070,429 A * | 6/2000 | Low | F25J 1/0022 | 62/612 |
| 7,234,322 B2 * | 6/2007 | Hahn | F25J 3/0209 | 62/620 |

*Primary Examiner* — Keith Raymond

(74) *Attorney, Agent, or Firm* — ConocoPhillips Company

(57) ABSTRACT

Methods and systems for removing nitrogen during liquefaction of natural are provided. Methods of removing nitrogen include warming a predominantly methane stream in a methane cold box to provide a warmed predominantly methane stream; conducting at least a portion of the warmed predominantly methane stream from the methane cold box to a nitrogen removal unit comprising at least a first nitrogen removal column and a last nitrogen removal column, wherein the first nitrogen removal column is located upstream of the last nitrogen removal column; passing the warmed predominantly methane stream through the last nitrogen removal column to provide a refluxed warmed predominantly methane stream; and routing at least a portion of the refluxed warmed predominantly methane stream to the last nitrogen removal column.

8 Claims, 4 Drawing Sheets

NITROGEN REJECTION UNIT

CROSS-REFERENCE TO RELATED APPLICATIONS

This non-provisional patent application claims priority to and the benefit of U.S. Provisional Patent Application No. 61/770,481, filed Feb. 28, 2013, which is incorporated herein by reference.

FIELD OF THE INVENTION

The present invention relates generally to liquefaction of natural gas. More particularly, but not by way of limitation, embodiments of the present invention include systems and methods for removing nitrogen during liquefaction of natural gas.

BACKGROUND OF THE INVENTION

Natural gas is an important resource widely used as energy source or as industrial feedstock used in, for example, manufacture of plastics. Comprising primarily of methane, natural gas is a mixture of naturally occurring hydrocarbon gases and is typically found in deep underground natural rock formations or other hydrocarbon reservoirs. Other components of natural gas include, but are not limited to, ethane, propane, carbon dioxide, nitrogen, and hydrogen sulfide.

Typically, natural gas is transported from source to consumers through pipelines that physically connect a reservoir to a market. Because natural gas is sometimes found in remote areas devoid of necessary infrastructure (e.g., pipelines), alternative methods for transporting natural gas are needed. This situation commonly arises when the source of natural gas and the market are separated by great distances such as a large body of water. Bringing this natural gas from remote areas to market can have significant commercial value if the cost of transporting natural gas is minimized.

One alternative method of transporting natural gas involves converting natural gas into a liquefied form through a liquefaction process. Because natural gas is gaseous under standard atmospheric conditions, it must be subjected to certain thermodynamic processes in order to be liquefied. In its liquefied form, natural gas has a specific volume that is significantly lower than its specific volume in its gaseous form. Thus, the liquefaction process greatly increases the ease of transporting and storing natural gas, particularly in cases where pipelines are not available. For example, ocean liners carrying LNG tanks can effectively link a natural gas source with a distant market when the source and market are separated by large bodies of water.

Converting natural gas to its liquefied form can have other economic benefits. For example, storing LNG can help balance out periodic fluctuations in natural gas supply and demand. In particular, LNG can be more easily "stockpiled" for later use when natural gas demand is low and/or supply is high. As a result, future demand peaks can be met with LNG from storage, which can be vaporized as demand requires.

In some instances, natural gas streams can contain relatively high concentrations of nitrogen. Nitrogen is inert and lowers the energy value per volume of natural gas. Thus, specification for natural gas pipelines typically limit the concentration of nitrogen. Limiting the concentration of nitrogen may also be important during liquefaction of natural gas. High nitrogen concentrations in natural gas that is subjected to liquefaction in a LNG facility can present one or more of the following drawbacks: (1) the natural gas can be more difficult to condense; (2) the heating value of the natural gas used as fuel gas for the LNG facility's gas turbines can be greatly diminished; and (3) LNG produced by the facility may be out of spec.

Some LNG facilities employ nitrogen removal units (NRUs) to lower the concentration of nitrogen in the natural gas stream to an acceptable level. Some conventional nitrogen rejection units (NRU) integrated within an LNG facility may be arranged in a two or three column configuration. Liquefaction processes using conventional three column NRU often relies solely on auto-refrigeration. Some of the problems associated with conventional three column NRU processes include, but are not limited to, slow startup and unstable operation due to variable feed compositions. These NRU columns are usually non-refluxed stripped or reboiled absorbers and can produce a nitrogen vent stream. Another drawback of some conventional nitrogen rejection units is that the resulting nitrogen vent stream can contain relatively high levels of methane. Some conventional nitrogen rejection units produce nitrogen vent streams containing between about 1% to about 1.5% methane (by mole %).

BRIEF SUMMARY OF THE DISCLOSURE

The present invention relates generally to liquefaction of natural gas. More particularly, but not by way of limitation, embodiments of the present invention include systems and methods for removing nitrogen during liquefaction of natural gas.

One example of a method for removing nitrogen from a natural gas stream comprises: (a) routing the natural gas stream from a main liquefaction process to a nitrogen rejection unit comprising: a first distillation column, a second distillation column, a third distillation column, and a condenser, wherein the main liquefaction process comprises: one or more refrigeration cycles external to the nitrogen rejection unit, and wherein the first distillation column is optional if the natural gas stream comprises at least about 50 mole % nitrogen; (b) at least partially condensing the natural gas stream via the condenser, wherein the condenser utilizes a refrigerant used to transfer heat in the one or more refrigeration cycles to form a condensed natural gas stream; and (c) routing at least a portion of the condensed natural gas stream to the third distillation column to separate the at least a portion of the condensed natural gas stream into a third top fraction and a third bottom fraction.

Another example of a method for removing nitrogen from a natural gas stream comprises: (a) routing the natural gas stream from a methane cold box of a main liquefaction process to a nitrogen rejection unit comprising: a first distillation column, a second distillation column, a third distillation column, and a condenser, wherein the main liquefaction process comprises: one or more refrigeration cycles external to the nitrogen rejection unit; (b) at least partially condensing the natural gas stream via the condenser, wherein the condenser utilizes a refrigerant used to transfer heat in the one or more refrigeration cycles to form a condensed natural gas stream; and (c) routing at least a portion of the condensed natural gas stream to the third distillation column to separate the at least a portion of the condensed natural gas stream into a third top fraction and a third bottom fraction, wherein the third top fraction comprises a predominantly nitrogen gas stream.

One example of a nitrogen rejection unit comprises: an upstream nitrogen removal column, and a downstream nitrogen removal column; and a condenser that provides condensing duty to the upstream nitrogen removal column, wherein the condenser is configured to at least partially condense a nitrogen-containing stream via indirect heat exchange with a recycled refrigerant stream.

One example of an LNG facility comprises: one or more refrigeration cycles for successively cooling a fluid stream, each refrigeration cycle comprising: a refrigerant, a compressor, and a chiller; and a nitrogen rejection unit comprising: an upstream nitrogen removal column, and a downstream nitrogen removal column; and a condenser that provides condensing duty to the upstream nitrogen removal column, wherein the condenser is configured to at least partially condense the fluid stream via indirect heat exchange with the refrigerant.

One example of a method for liquefying natural gas comprises: (a) feeding a predominantly methane stream to a nitrogen removal unit; (b) conducting at least a portion of the predominantly methane stream to the nitrogen removal unit comprising at least a first nitrogen removal column and a last nitrogen removal column, wherein the first nitrogen removal column is located upstream of the last nitrogen removal column; (c) passing the predominantly methane stream through the last nitrogen removal column to provide an overhead predominantly nitrogen stream; (d) generating a reflux nitrogen stream via nitrogen compressor system; and (e) routing at least a portion of the refluxed nitrogen stream to the last nitrogen removal column.

Another example of a method for liquefying natural gas comprises: (a) feeding a predominantly methane stream from a methane cold box to a nitrogen removal unit; (b) conducting at least a portion of the predominantly methane stream from the methane cold box to the nitrogen removal unit comprising at least a first nitrogen removal column, an intermediate nitrogen removal column, a last nitrogen removal column, and a nitrogen compressor system, wherein the nitrogen compressor system is located downstream of the nitrogen removal columns; (c) passing the predominantly methane stream through the first nitrogen removal column, the intermediate nitrogen removal column, and the last nitrogen removal column, wherein the last nitrogen removal column provides an overhead predominantly nitrogen stream; (d) generating a refluxed nitrogen stream via the nitrogen compressor system; and (e) routing at least a portion of the refluxed nitrogen stream to the last nitrogen removal column.

One example of a nitrogen removal unit comprises: a) a first nitrogen removal column, a last nitrogen removal column, and a nitrogen compressor system, wherein the nitrogen compressor system is located downstream of the last nitrogen removal column; b) a first outlet configured to remove nitrogen from the last nitrogen removal column; and c) a second outlet configured to cycle at least a portion of a refluxed nitrogen stream.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
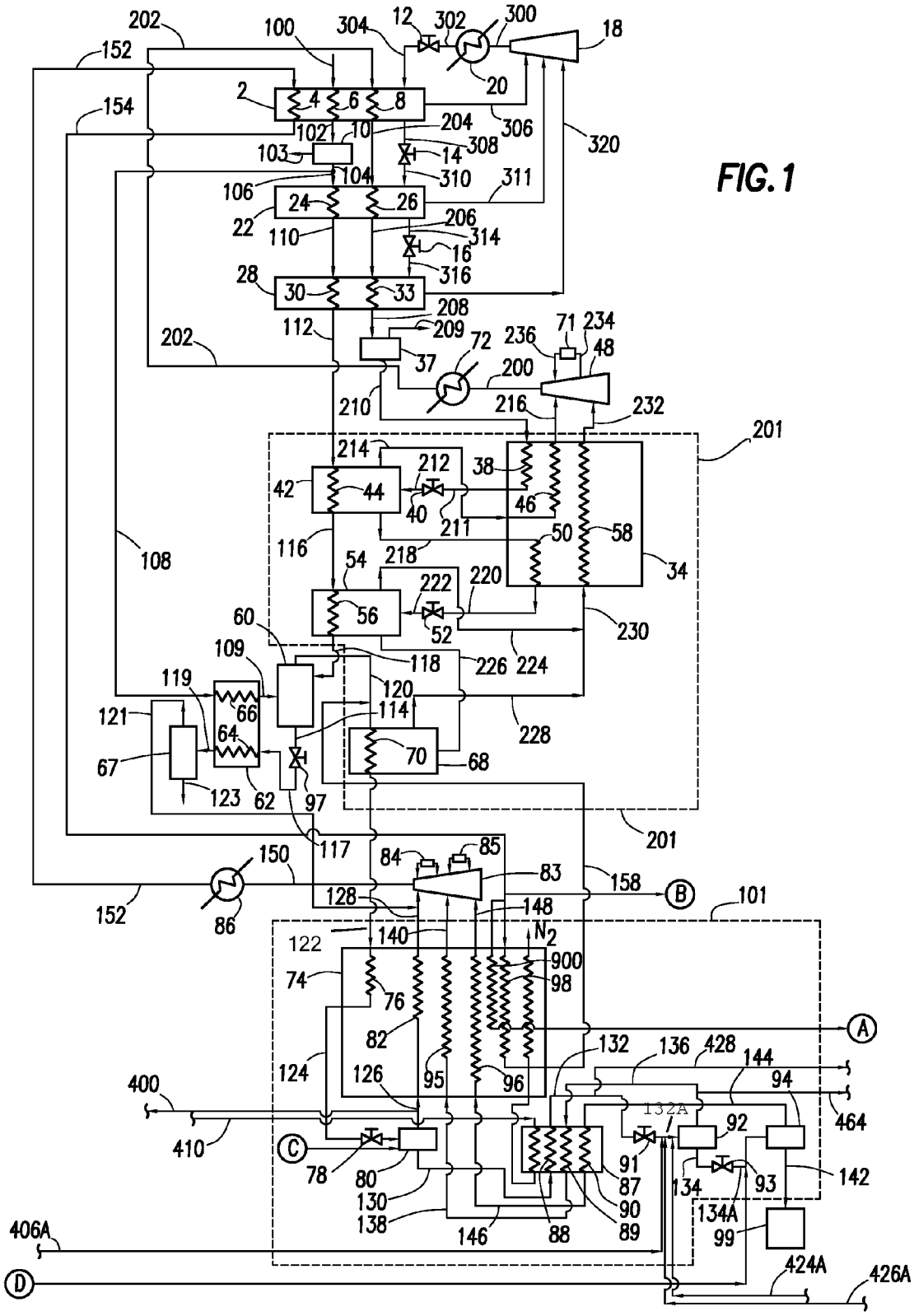
FIG. 1 is a simplified flow diagram of a cascade refrigeration process for LNG production employing an integrated nitrogen rejection unit.

The present invention relates generally to liquefaction of natural gas. More particularly, but not by way of limitation, embodiments of the present invention include systems and methods for removing nitrogen during liquefaction of natural gas.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

The present invention provides systems and methods related to increasing nitrogen separation efficiency during an LNG process, reducing emissions of potentially environmentally-hazardous materials such as methane, improving process efficiency over many existing nitrogen rejection unit technologies, and/or providing stable operation for both nitrogen rejection unit and main process. As compared to many conventional systems and methods, advantages of certain embodiments of liquefying natural gas methods and systems described herein include, but are not limited to, one or more of the following:

- shortens startup time of NRU,
- improves stability of operation (e.g., due to variable feed composition),
- improves efficiencies of NRU and overall LNG process,
- increased nitrogen, helium, and/or argon separation efficiency,
- reduction in hydrocarbon emissions (e.g., methane),
- reduction in overall greenhouse emissions,
- increased LNG process stability,
- complies with higher environmental standards.

Other advantages will be apparent from the disclosure herein.

The present invention can be implemented in a process and/or facility used to cool natural gas to its liquefaction temperature. An LNG process generally employs one or more refrigerants to extract heat from the natural gas and then reject the heat to its environment. This overall refrigeration system functions as a sort of heat pump by removing heat energy from a natural gas stream as the natural gas stream is progressively cooled to lower and lower temperatures.

Cascade LNG Process

The present invention can be implemented in a facility used to cool natural gas to its liquefaction temperature to produce liquefied natural gas (LNG). The LNG facility generally employs one or more refrigerants to extract heat from the natural gas and reject to the environment. Numerous configurations of LNG systems exist and the present invention may be implemented in many different types of LNG systems.

In one embodiment, the present invention can be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system. In another embodiment, the present invention is implemented in a cascade LNG system employing a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

In some embodiments, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may consider a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising 3 different refrigerants in 3 separate refrigeration cycles is made, this is not intended to be limiting. For example, a cascade LNG process involving any number of refrigerants and/or refrigeration cycles may be compatible with one or more embodiments of the present invention. Other variations to the cascade LNG process may also be contemplated. In another embodiment, the nitrogen rejection unit of the present invention may be utilized in non-cascade LNG processes. One example of a non-cascade LNG process involves a mixed refrigerant LNG process that employs a combination of two or more refrigerants to cool the natural gas stream in at least one cooling cycle.

According to one or more embodiments of the present invention, a predominately methane stream may be employed as the refrigerant/cooling agent in an open cycle. This predominantly methane stream may originate from a processed natural gas feed stream and can include compressed open methane cycle gas streams.

At least one efficient and effective means of liquefying natural gas utilizes an optimized cascade-type operation in combination with expansion-type cooling. Such a liquefaction process involves the cascade-type cooling of a natural gas stream at an elevated pressure (e.g., about 650 psia) which is achieved by sequentially cooling the gas stream via passage through one or more cycles including a multistage propane cycle, a multistage ethane or ethylene cycle, and an open methane cycle. In particular, the open methane cycle may utilize a portion of the feed gas as a source of methane and includes a multistage expansion cycle to further cool the same and reduce the pressure to near-atmospheric pressure. In the sequence of cooling cycles, the refrigerant with a highest boiling point is utilized first followed by the refrigerant with an intermediate boiling point and finally by the refrigerant with a lowest boiling point.

The natural gas feed stream can vary significantly in its composition and contain undesirable components such as, but not limited to, acid gases, mercaptan, mercury, and moisture. Various pretreatment steps can remove the undesirable components. Pretreatment steps may be separate steps located either upstream of cooling cycles or located downstream of one of the early stages of cooling in the initial cycle. Such pretreatment steps are readily known to one skilled in the art. For example, acid gases and to a lesser extent mercaptan can be removed via a chemical reaction process employing an aqueous amine-bearing solution. This treatment step is generally performed upstream of the cooling stages in the initial cycle. A major portion of the water can be removed as a liquid via two-phase gas-liquid separation following gas compression and cooling upstream of the initial cooling cycle and also downstream of the first cooling stage in the initial cooling cycle. Mercury can be removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, between about 500 psia to about 3000 psia, between about 500 psia to about 1000 psia, between about 600 psia to about 800 psia. Temperature of the pretreated natural gas feed stream is typically near ambient to slightly below ambient. A representative temperature range is from about 60° F. (16° C.) to about 77° F. (25° C.).

As described earlier, the natural gas feed stream is cooled via a plurality of multistage cycles or steps (e.g., three) by indirect heat exchange with a plurality of different refrigerants (e.g., three). Generally, overall cooling efficiency for a given cycle improves as the number of stages increases. However, this increase in efficiency is often accompanied by corresponding increases in net capital cost and process complexity.

In some embodiments, the feed gas is passed through 2 refrigeration stages, 3 refrigeration stages, or 4 refrigeration stages. In one embodiment, the first refrigeration cycle is closed and utilizes a relatively high boiling first refrigerant. The first refrigerant may comprise a major portion of propane, propylene, or mixtures thereof. In some embodiments, the first refrigerant comprises at least about 75 mole percent propane, at least about 90 mole percent propane, or the refrigerant consists essentially of propane. In some embodiments, the second refrigeration cycle is closed and contains a second refrigerant having a relatively lower boiling point. The second refrigerant may comprise in major portion of ethane, ethylene, or mixtures thereof. In some embodiments, the second refrigerant comprises at least about 75 mole percent ethylene, at least about 90 mole percent ethylene, or consists essentially of ethylene. Each cooling stage may comprise a separate cooling zone. As previously noted, the processed natural gas feed stream can be combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion (e.g., in its entirety) to produce a pressurized LNG-bearing stream. Generally, the process pressure at this location is only slightly lower than the pressure of the pretreated feed gas to the first stage of the first cycle.

The natural gas feed stream will typically contain such quantities of $C_2$+ components so as to result in the formation of a $C_2$+ rich liquid in one or more of the cooling stages. This liquid is removed via gas-liquid separation means such as, but not limited to, one or more conventional gas-liquid separators. The sequential cooling of the natural gas in each stage can be controlled so as to remove as much of the $C_2$ and higher molecular weight hydrocarbons as possible from the gas to produce a gas stream comprising predominately methane and a liquid stream containing significant amounts of ethane and heavier components. An effective number of gas/liquid separation means are located at strategic locations downstream of the cooling zones for the removal of liquids streams rich in $C_2$+ components. Exact locations and number of gas/liquid separation means such as, but not limited to, conventional gas/liquid separators, will depend on a number of operating parameters such as, but not limited to, $C_2$+ composition of the natural gas feed stream, desired BTU content of the LNG product, value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycled or used as fuel gas. The $C_2$+ hydrocarbon stream or streams or the demethanized $C_2$+ hydrocarbon stream may be used as fuel or may be further processed by means such as fractionation in one or more fractionation zones to produce individual streams rich in specific chemical constituents (e.g., $C_2$, $C_3$, $C_4$, and $C_5$+).

Pressurized LNG-bearing stream can then be subsequently cooled in a third open methane cycle which results in sequential expansion of the pressurized LNG-bearing stream to near atmospheric pressure. Flash gasses used as a refrigerant in the third refrigeration cycle may comprise in major portion of methane, at least 75 mole percent methane, at least 90 mole percent methane, or may consist essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. In at least one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and may be recompressed.

The liquefaction process described herein may incorporate one of several types of cooling means including, but not limited to, (a) indirect heat exchange, (b) vaporization, and (c) expansion or pressure reduction. Indirect heat exchange, as used herein, refers to a process in which the refrigerant cools the substance to be cooled without actual physical contact between the refrigerating agent and the substance to be cooled. Specific examples of indirect heat exchange means include heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen. For example, a shell-and-tube heat exchanger may be utilized where the refrigerant is in a liquid state and the substance to be cooled is in a liquid or gaseous state or when one of the substances undergoes a phase change and process conditions do not favor the use of a core-in-shell heat exchanger, for example. In some embodiments, aluminum and aluminum alloys may be used in constructing the core but such materials may not be suitable for use at designated process conditions. A plate-fin heat exchanger may be utilized where the refrigerant is in a gaseous state and the substance to be cooled is in a liquid or gaseous state. Finally, the core-in-shell heat exchanger may be utilized where the substance to be cooled is liquid or gas and the refrigerant undergoes a phase change from a liquid state to a gaseous state during the heat exchange.

Vaporization cooling refers to the cooling of a substance by evaporation or vaporization of a portion of the substance at a constant pressure. During vaporization, portion of the substance which evaporates absorbs heat from portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In some embodiments, expansion means may be a Joule-Thomson expansion valve. In other embodiments, the expansion means may be either a hydraulic or gas expander. Because expanders recover work energy from the expansion process, lower process stream temperatures are possible upon expansion.

Figure 2:
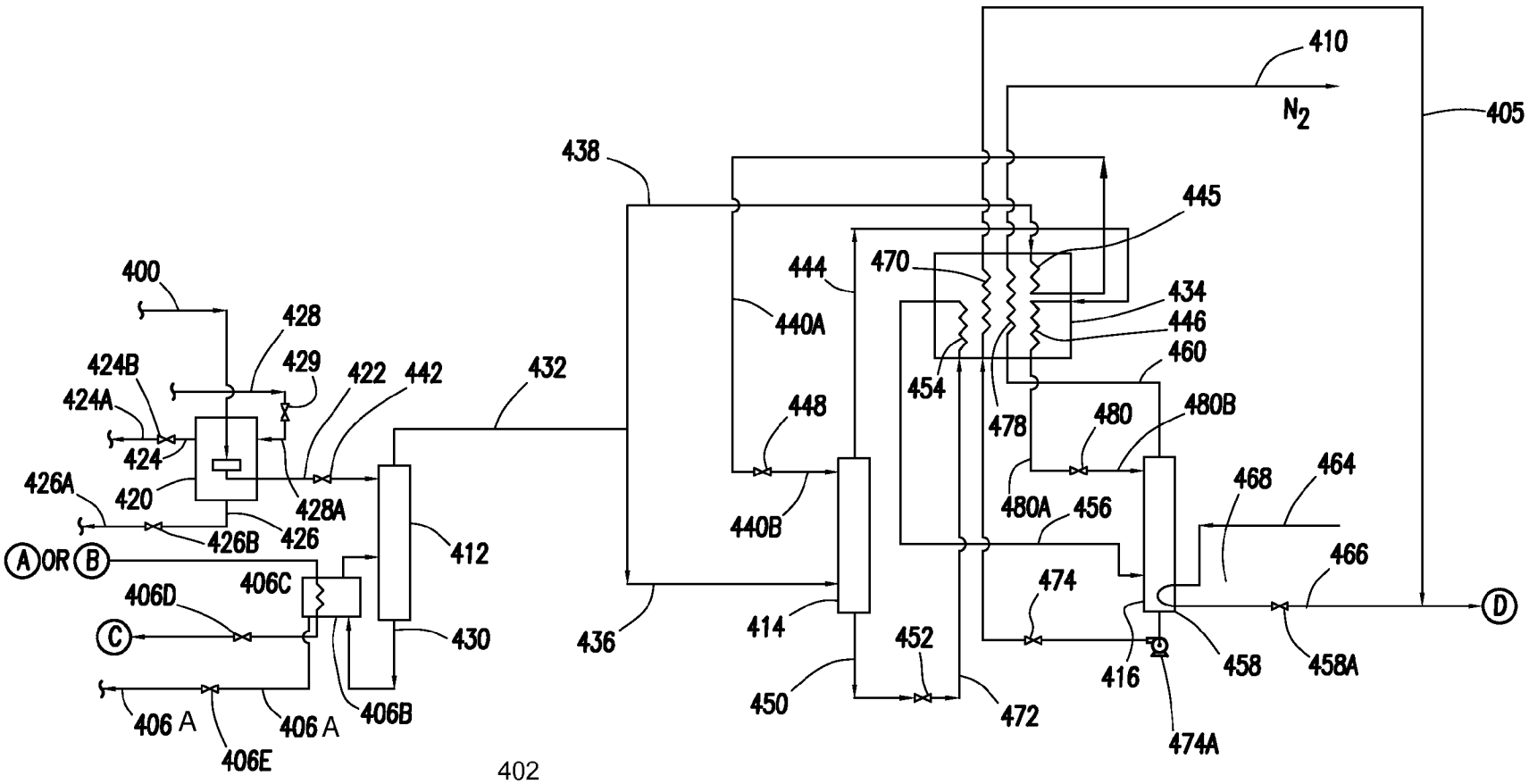
FIG. 2 is a flow diagram of one aspect of the integrated nitrogen rejection unit from FIG. 1.
Figure 3:
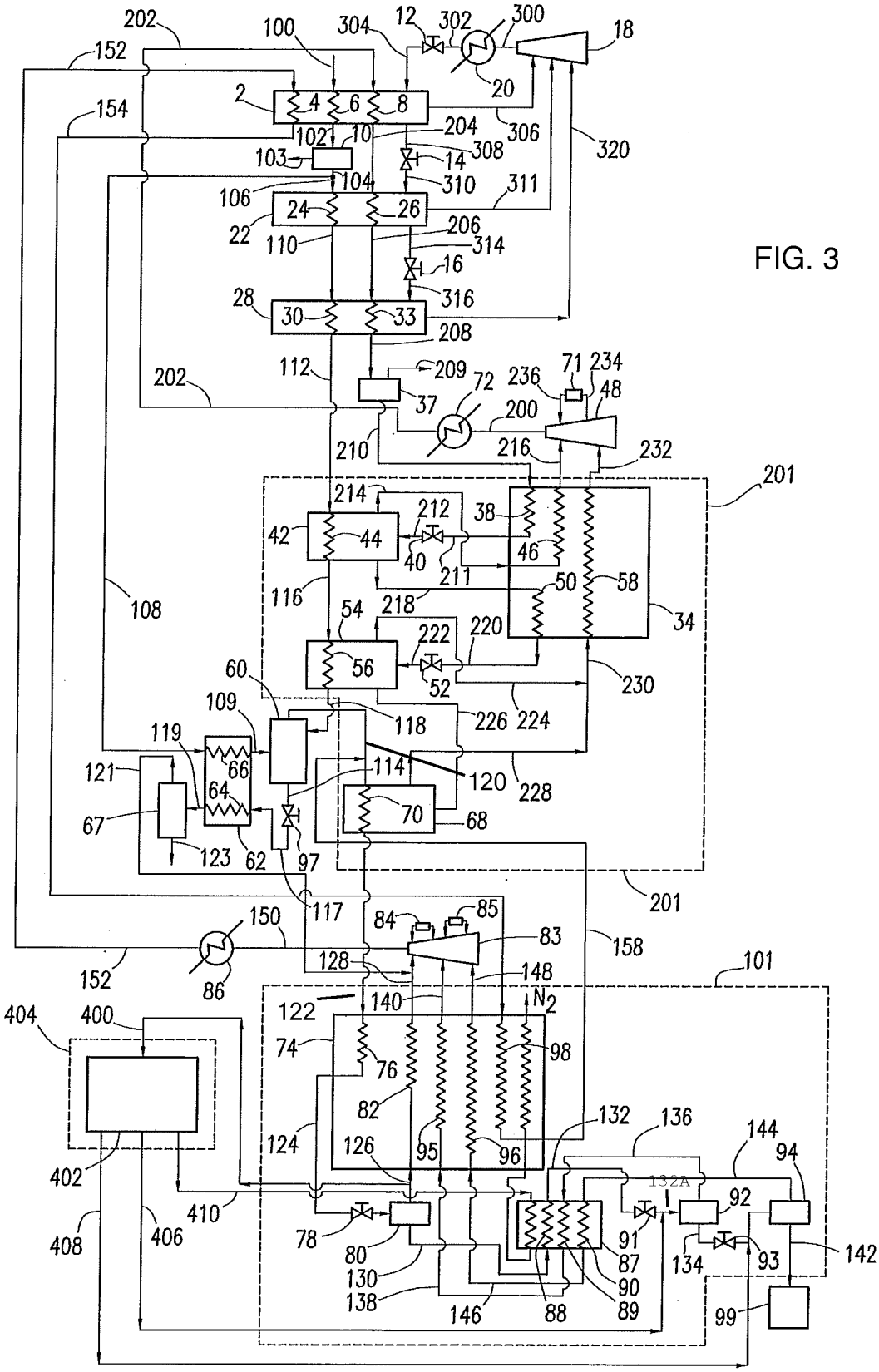
FIG. 3 is a simplified flow diagram of a cascade refrigeration process for LNG production employing a refluxed nitrogen rejection unit.
Figure 4:
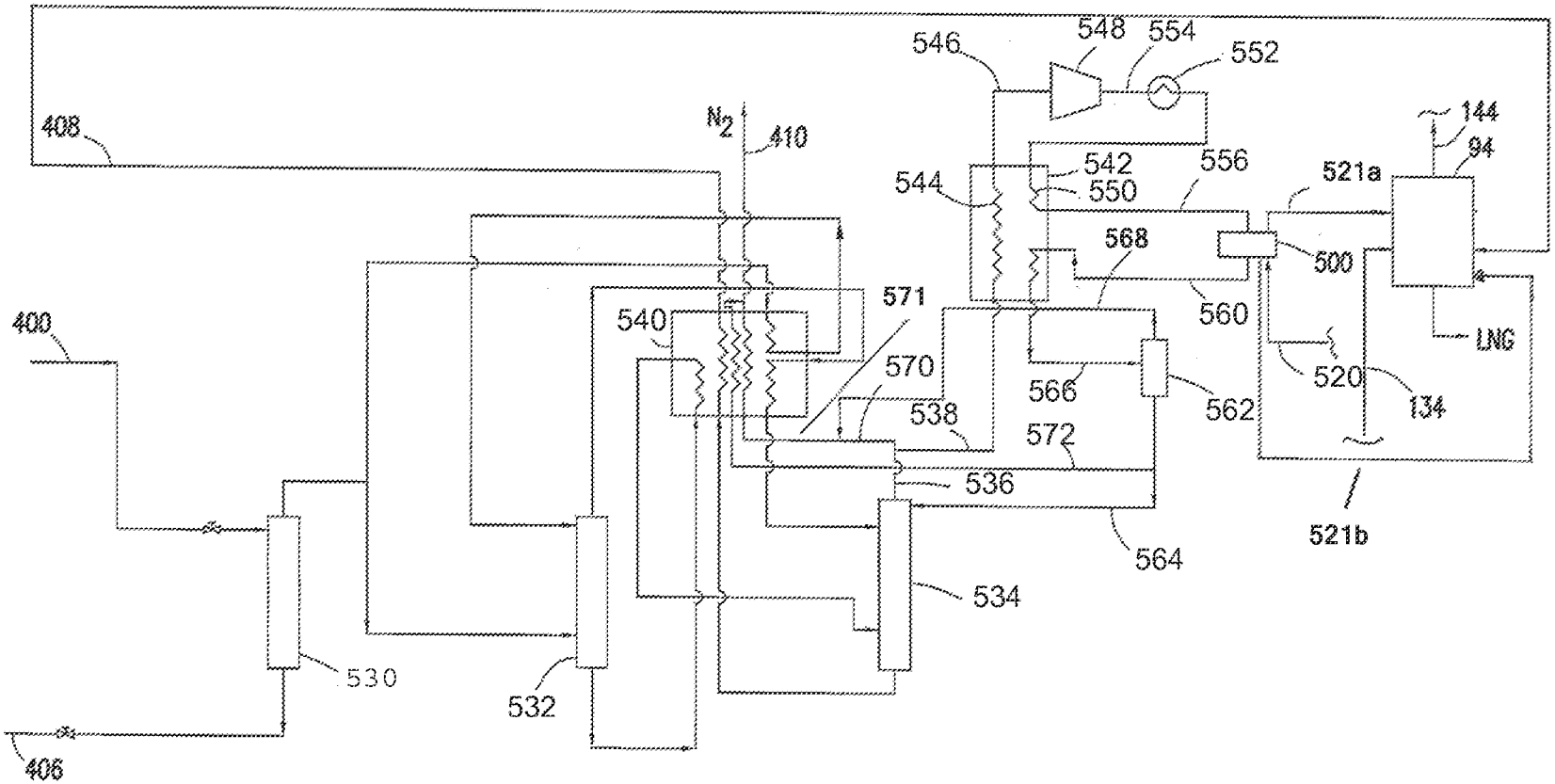
FIG. 4 is a flow diagram of one aspect of the refluxed nitrogen rejection unit from FIG. 1.

In the embodiments represented in FIGS. 1-4, propane is the first refrigerant, ethylene is the second refrigerant, and methane is the third refrigerant. The flow schematic and apparatus set forth in FIG. 1 represents an embodiment of the LNG facility employing an integrated nitrogen rejection unit. FIG. 2 represents aspect of the integrated nitrogen rejection unit. FIG. 3 represents an embodiment of the LNG facility employing a refluxed nitrogen rejection unit. FIG. 4 represents aspect of the refluxed nitrogen rejection unit. Those skilled in the art will recognize that FIGS. 1-4 are schematics only and, therefore, many items of equipment that would be needed in a commercial plant for successful operation have been omitted for sake of clarity. Such items might include, for example, compressor controls, flow and level measurements and corresponding controllers, temperature and pressure controls, pumps, motors, filters, additional heat exchangers, valves, and the like. These items would be provided in accordance with standard engineering practice.

Referring to FIGS. 1 and 3, gaseous propane is compressed in a multistage (three-stage) compressor 18 driven by a gas turbine driver (not illustrated). The three stages of compression may exist in a single unit although each stage of compression may be a separate unit and the units are mechanically coupled and driven by a single driver. Upon compression, compressed propane is passed through conduit 300 to a cooler 20 where it is cooled and liquefied. A representative pressure and temperature of the liquefied propane refrigerant prior to flashing is about 100° F. (38° C.) and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product or a portion thereof then flows through conduit 304 into a high-stage propane chiller 2 therethrough gaseous methane refrigerant is introduced via conduit 152, natural gas feed is introduced via conduit 100, and gaseous ethylene refrigerant is introduced via conduit 202 and respectively cooled via indirect heat exchange means 4, 6, and 8 to produce cooled gas streams in conduits 154, 102, and 204 respectively. A portion of the gas in conduit 154 is fed to a main methane economizer 74 where the stream is cooled via indirect heat exchange means 98.

In FIG. 1, remaining portions of gas in conduit 154 can be fed to a main methane economizer 74 where the stream is cooled via indirect heat exchange 900 and removed through conduit A and/or removed prior to the main methane economizer through conduit B. In some embodiments, the main methane economizer cooling pass providing indirect heat means 900 may be omitted and conduit A may originate from, for example, cooling pass 98 directly or from stream 158 at the exit of cooling pass 98.

Referring to both FIGS. 1 and 3, the cooled compressed methane recycle stream produced via conduit 158 is then combined in conduit 120 with heavies depleted (i.e., light-hydrocarbon rich) vapor stream produced from a heavies removal column 60 and fed to ethylene chiller 68. The propane gas from chiller 2 is returned to compressor 18 through conduit 306. This gas is fed to the high-stage inlet port of compressor 18. Remaining liquid propane is passed through conduit 308 and pressure is further reduced by passage through a pressure reduction means, illustrated as expansion valve 14, whereupon an additional portion of the liquefied propane is flashed. The resulting two-phase stream is then fed to an intermediate stage propane chiller 22 through conduit 310 to provide a coolant for chiller 22. The cooled feed gas stream from chiller 2 flows via conduit 102 to separation equipment 10 where, in some embodiments, a separate liquid phase containing $C_3$+ components, may be removed via conduit 103. The gaseous phase is removed via conduit 104 and then split into two separate streams via conduits 106 and 108. The stream in conduit 106 is fed to propane chiller 22. The stream in conduit 108 becomes the feed to heat exchanger 62 and ultimately used as a stripping or heating gas for heavies removal column 60.

As illustrated in FIGS. 1 and 3, ethylene refrigerant from chiller 2 is introduced to chiller 22 via conduit 204. In chiller 22, the feed gas stream, also referred to herein as methane-rich stream, and the ethylene refrigerant streams are respectively cooled via indirect heat transfer means 24 and 26 to produce cooled methane-rich and ethylene refrigerant streams via conduits 110 and 206. Evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

Referring still to FIGS. 1 and 3, the methane-rich stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 33. The vaporized propane is removed from low-stage propane chiller 28 and returned to the low-stage inlet of compressor 18 via conduit 320.

As illustrated in FIGS. 1 and 3, the methane-rich stream exiting low-stage propane chiller 28 is introduced to high-stage ethylene chiller 42 via conduit 112. Ethylene refrigerant exits low-stage propane chiller 28 via conduit 208 and is fed to a separation vessel 37 where light components are removed via conduit 209 and condensed ethylene is removed via conduit 210. The ethylene refrigerant at this location in the process is at a temperature of about −24° F. (−31° C.) and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and fed to the high-stage inlet of ethylene compressor 48. The ethylene refrigerant portion that is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. This stream is then condensed in part via cooling provided by indirect heat exchange means 56 in low-stage ethylene chiller 54, thereby producing a two-phase stream which flows via conduit 118 to heavies removal column 60. As previously noted, the methane-rich stream in line 104 was split so as to flow via conduits 106 and 108. The contents of conduit 108, which is referred to herein as the stripping gas, is first fed to heat exchanger 62 wherein this stream is cooled via indirect heat exchange means 66 thereby becoming a cooled stripping gas stream which then flows via conduit 109 to heavies removal column 60. A heavies-rich liquid stream containing a significant concentration of $C_4$+ hydrocarbons, such as benzene, cyclohexane, other aromatics, and/or heavier hydrocarbon components, is removed from heavies removal column 60 via conduit 114, flashed via a flow control means 97 such as, but not limited to, a control valve which can also function as a pressure reduction, and transported to heat exchanger 62 via conduit 117. The stream flashed via flow control means 97 is flashed to a pressure about or greater than the pressure at the high stage inlet port to methane compressor 83. Flashing also imparts greater cooling capacity to the stream. In heat exchanger 62, the stream delivered by conduit 117 provides cooling capabilities via indirect heat exchange means 64 and exits heat exchanger 62 via conduit 119. In heavies removal column 60, the two-phase stream introduced via conduit 118 is contacted with the cooled stripping gas stream introduced via conduit 109 in a countercurrent manner thereby producing a heavies-depleted vapor stream via conduit 120 and a heavies-rich liquid stream via conduit 114.

The heavies-rich stream in conduit 119 is subsequently separated into liquid and vapor portions or preferably flashed or fractionated in vessel 67. In either case, a heavies-rich liquid stream is produced via conduit 123 and a second methane-rich vapor stream is produced via conduit 121. The stream in conduit 121 is subsequently combined with a second stream delivered via conduit 128, and the combined stream fed to the high-stage inlet port of the methane compressor 83.

As previously noted, the gas in conduit 154 is fed to main methane economizer 74 wherein the stream is cooled via indirect heat exchange means 98. The resulting cooled compressed methane recycle or refrigerant stream in conduit 158 is combined with the heavies-depleted vapor stream from heavies removal column 60, delivered via conduit 120, and fed to a low-stage ethylene chiller 68. In low-stage ethylene chiller 68, this stream is cooled and condensed via indirect heat exchange means 70 with the liquid effluent from valve 222 which is routed to low-stage ethylene chiller 68 via conduit 226. The condensed methane-rich product from low-stage condenser 68 is produced via conduit 122. The vapor from low-stage ethylene chiller 54, withdrawn via conduit 224, and low-stage ethylene chiller 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As shown in FIGS. 1 and 3, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. The two-stages are single module although each may be a separate module and/or mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream (e.g., a liquid stream in its entirety) in conduit 122 is preferably at a temperature in the range of from about −200 to about −50° F. (−129 to −46° C.), more preferably in the range of from about −175 to about −100° F. (−115 to −73° C.), most preferably in the range of from −150 to −125° F. (−101 to −87° C.). The pressure of the stream in conduit 122 is preferably in the range of from about 500 to about 700 psia, most preferably in the range of from 550 to 725 psia.

The stream in conduit 122 is directed to a main methane economizer 74 wherein the stream is further cooled by indirect heat exchange means/heat exchanger pass 76 as hereinafter explained. The main methane economizer 74 may include a plurality of heat exchanger passes which provide for the indirect exchange of heat between various predominantly methane streams in the economizer 74. The methane economizer 74 may comprise one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F. (−129 to −107° C.). The pressure of the stream in conduit 124 is then reduced by a pressure reduction means, illustrated as expansion valve 78, which evaporates or flashes a portion of the gas stream thereby generating a two-phase stream.

The two-phase stream from expansion valve 78 is either combined with flow from conduit C (FIG. 1) or passed directly to high-stage methane flash drum 80 (FIGS. 1 and 3) where it is separated into a flash gas stream discharged through conduit 126 and a liquid phase stream (i.e., pressurized LNG-bearing stream) discharged through conduit 130. In some embodiments, conduit C is passed directly to high-stage methane flash drum 80 without combining with stream 126, such that both streams enter high-stage methane flash drum 80 separately. In some alternative embodiments, conduit C may combine with stream 126 or other suitable locations in the methane cold box, depending on the physical state (e.g., vapor or liquid or degree of two-phase) and operating conditions (e.g., temperature and pressure) of the fluid.

A portion of stream 126 is withdrawn and conducted to a nitrogen removal unit 402 via conduit 400. Conduit 400 is installed upstream of the methane economizer 74 resulting in a cold feed stream that is fed into the nitrogen rejection. In some alternative embodiments, conduit 400 may be installed downstream of the methane economizer 74 resulting in a warm feed stream. The amount of the flash gas stream drawn off of conduit 126 via conduit 400 may vary depending upon the concentration of nitrogen in the predominantly methane stream in conduit 126, as well as various other operating parameters of the LNG facility. The flash gas stream is then transferred to main methane economizer 74 via conduit 126 wherein the stream functions as a coolant in heat exchanger pass 82 and aids in the cooling of the stream in heat exchanger pass 76, 98, and 900 (FIG. 1 only). Thus, the predominantly methane stream in heat exchanger pass 82 is warmed, at least in part, by indirect heat exchange with exchanger passes 76, 98, and 900 (FIG. 1 only). The warmed stream exits heat exchanger pass 82 and methane economizer 74 via conduit 128.

As used herein, the term "cold box" shall denote an insulated enclosure housing a plurality of components within which a relatively cold fluid stream is processed. As used herein, the term "methane cold box" shall denote a cold box within which predominantly methane streams are employed to cool a natural gas stream. As used herein, the term "ethylene cold box" shall denote a cold box within which predominantly ethylene streams are employed to cool a natural gas stream. As used herein, the term "nitrogen cold box" shall denote a cold box housing equipment for removing nitrogen from a natural gas stream. Methane cold box 101 preferably houses methane economizer 74, as well as the various sequential expansion and separation components of the expansion-type cooling cycle. Ethylene cold box 201 preferably houses ethylene economizer 34, as well as the various chillers 42, 54, 58, which employ a predominantly ethylene refrigerant to cool the natural gas stream. The nitrogen rejection unit may be housed in a separate insulated enclosure to form a nitrogen cold box or integrated within the methane cold box. The nitrogen rejection unit is described in detail below with references to FIGS. 2 and 4.

Referring to FIGS. 1-4, a significant portion of the nitrogen present in the predominantly methane stream in conduit 400 is removed and the removed nitrogen (i.e., nitrogen-rich) stream exits the nitrogen rejection unit and returns to the methane cold box via conduit 410. Referring to the embodiment shown in FIGS. 1-2, the nitrogen rejection unit produces a first nitrogen-reduced (i.e., nitrogen-depleted) stream returning to the methane cold box via conduit 406A and a second nitrogen-reduced (i.e., nitrogen-depleted) returning to the methane cold box via conduit D. In some alternative embodiments, conduit 406A and conduit D may be combined prior to returning to the methane cold box. The first nitrogen-reduced stream in conduit 406A (FIG. 1) or 406 (FIG. 3) is combined with the cooled liquid 132A after being expanded or flashed via a pressure reduction means, illustrated here as expansion valve 91 and routed to intermediate-stage methane flash drum 92. In some alternative embodiments, conduits 406A and D may be routed separately to the intermediate-stage methane flash drum 92.

Referring to FIG. 2, the second nitrogen-reduced stream in conduit 405 is combined with the stream in conduit 466 to form a combined stream in conduit D. Referring to FIG. 1, the combined stream in conduit D is combined with the liquid phase stream passing through conduit 134A after the liquid phase stream contained in conduit 134 is reduced in pressure by passage through a pressure reduction means, illustrated as expansion valve 93, prior to entering the low-stage methane flash drum 94. In some embodiments, conduits 408, 466 and 134A may be fed to low-stage methane flash drum 94 separately or combined in any suitable manner.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and flash to form a vapor portion thereof in conduit 132A. This two-phase stream 132A is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140 and conducted to the intermediate-stage inlet of methane compressor 83.

The liquid phase exiting intermediate-stage flash drum 92 via conduit 134 is further reduced in pressure by passage through a pressure reduction means, illustrated as expansion valve 93. Again, a third portion of the liquefied gas is evaporated or flashed to form a two-phase stream in conduit 134A. The two-phase stream 134A is combined with conduit D, or in some embodiments conduits 408 and 466, as described earlier, before routing to the final or low-stage flash drum 94. In some embodiments, conduits 408, 466 and 134A may be routed separately to low-stage methane flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148 and conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

In some embodiments, the high, intermediate, and low stages of compressor 83 are preferably separated into separate compressor bodies mechanically coupled together to be driven by a single driver (not illustrated). In some embodiments, two or more compressor stages may be combined in a single body. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 of which all or a portion of stream 154 enters the main methane economizer 74 and undergoes cooling via through indirect heat exchange means 98. This cooled stream is then removed via conduit 158 and combined with the processed natural gas feed stream upstream of the first stage of ethylene cooling.

Integrated Nitrogen Rejection Unit

The integrated nitrogen rejection unit according to one or more embodiments integrates external heat and refrigerant sources contained within an LNG or gas plant to enhance thermal and separation efficiency as well as overall operating flexibility and stability. This design also allows independent adjustment of refrigerant and heat sources to allow adjustments for wider variations in feed composition and promote greater turn down capacity.

As shown in FIG. 2, cold feed natural gas stream in conduit 400 is fed into to the nitrogen rejection unit, where the stream is either fully or partially condensed in a core-in-shell exchanger 420. In some embodiments, exchanger types such as, but not limited to, kettle exchanger with a conventional tube bundle, shell and tube exchangers, brazed aluminum heat exchangers and/or printed circuit heat exchangers may be used. The condensed or partially condensed stream exits the core-in-shell exchanger 420 via conduit 422 and undergoes pressure reduction via pressure reduction means, illustrated here as expansion valve 442. The resulting expanded stream is then fed into the first nitrogen column 412. The first nitrogen column 412 can perform pre-separation of the feed stream to concentrate nitrogen in the first nitrogen column 412 to approximately 50% or greater, while minimizing nitrogen returning to the main liquefaction process. In the embodiment illustrated in FIG. 2, the first nitrogen column 412 is a reboiled absorber. In some embodiments, the first nitrogen column 412 may contain random packing, structured packing, trays or combinations thereof.

In the illustrated embodiment, the feed condenser duty for the core-in-shell exchanger is provided by a refrigerant stream (via conduit 428) taken from main liquefaction process as an external source to the nitrogen rejection unit. The refrigerant stream in conduit 428 is flashed via a pressure reduction means, illustrated here as expansion valve 429, to a two-phase mixture in conduit 428A and routed into core-in-shell exchanger 420 to provide condensing duty for the stream in conduit 400. The stream in conduit 428 represents a small portion of a larger stream within the main liquefaction process such that as much or as little refrigerant may be used as desired with minimal impact to the main liquefaction process. In this particular embodiment, the refrigerant source is not a pure or predominately pure component. For that reason, a small liquid stream from the core-in-shell exchanger 420 is removed in conduit 426 and undergoes a pressure reduction via a pressure reduction means, illustrated here as expansion valve 426B, before returning to the main liquefaction process via conduit 426A in order to prevent heavier components from concentrating over time and negatively impacting the refrigerant boiling temperature. The stream in conduit 424 undergoes a pressure reduction via a pressure reduction means, illustrated here as expansion valve 424B before returning to the intermediate-stage methane flash drum 92 via conduit 424A. In this particular embodiment, the boiling temperature of the refrigerant that provides condensing duty within the core-in-shell exchanger 420 may be adjusted as necessary or desired by adjusting the opening of expansion valve 429. As shown, the condensed, and in some embodiments subcooled, stream in conduit 422 is routed to the first nitrogen column 412.

Referring to FIG. 1, warm fluid, relative to the first nitrogen column 412, taken from the main liquefaction process through conduit A and/or B is routed to a first nitrogen column reboiler 406B to provide reboiler duty for the first nitrogen column 412, illustrated in FIG. 2. Reboiler duty for the first nitrogen column 412 is provided by indirect heat exchanger means 406C. The stream contained in conduit A and/or B is cooled, and in some embodiments cooled and condensed or partially condensed, through indirect heat exchange means 406C and subsequently undergoes pressure reduction via a pressure reduction means, illustrated here as expansion valve 406D, before returning to the main liquefaction process via conduit C. Conduit C is routed to the high-stage methane flash drum 80, and in some embodiments combined with the stream downstream of pressure reduction means 78 prior to entering the high-stage methane flash drum 80. Liquid is taken from the bottom of the first nitrogen column 412 and routed to the first nitrogen column reboiler 406B via conduit 430, where a portion of stream 430 is vaporized and subsequently returned to the first nitrogen column 412 as boil-up vapor. The remaining liquid is removed from the first nitrogen column reboiler 406B through conduit 406 and subsequently undergoes pressure reduction via a pressure reduction means, illustrated here as expansion valve 406E, before returning to the main liquefaction process in conduit 406A. The stream in conduit 406A may return to the main liquefaction process to a number of suitable locations. In this particular embodiment, stream 406A is combined with 132A, 424A and 426A prior to entering the intermediate-stage methane flash drum 92. In other embodiments, stream 406A may be routed separately to the intermediate-stage methane flash drum 92 or another suitable location.

Referring to FIG. 2, a portion of the first nitrogen column overhead vapor 432 is routed through conduit 438 and condensed or partially condensed in one pass of a multi-pass heat exchanger 434 before expanding, illustrated here as expansion valve 448, into the second nitrogen column top feed location via conduit 440B. In some embodiments, the second nitrogen column 414 may contain random packing, structured packing, trays or combinations thereof. The remaining non-condensed portion of the first nitrogen column overhead vapor in stream 432 is routed to a bottom feed location via conduit 436 to provide direct heating to the second nitrogen column 414 via stripping or heating gas.

The overhead stream 444 of second nitrogen column 414 is condensed or partially condensed in a second pass 446 of a multi-pass heat exchanger 434 before expanding, illustrated here as expansion valve 480, into the top feed of the third nitrogen column 416 via conduit 480B. All or a portion of the second nitrogen column bottom stream 450 is expanded through an expansion valve 452 to a lower pressure and heated in a third pass 454 of a multi-pass heat exchanger 434 before being routed to the bottom feed location of the third nitrogen column 416 via conduit 456 to provide direct heating to the third nitrogen column 416 via stripping or heating gas. A small separator (not shown) may be provided to assist in the liquid and vapor distribution through pass 454 of the multi-pass heat exchanger 434.

Still referring to FIG. 2, reboiler 458 is illustrated as a stab-in reboiler to the third nitrogen column 416. In some embodiments, the reboiler may be an external thermosyphon or kettle exchanger of various types and configurations. In some embodiments, direct heating may be provided through a stripping or warming gas. In this particular embodiment, warm vapor, relative to the third nitrogen column 416, is taken from the main liquefaction process via conduit 464 to provide heat duty for the third nitrogen column 416 via reboiler 458. The warm vapor routed to reboiler 458 via conduit 464 represents a small portion of a larger stream (in conduit 136) within the main liquefaction process such that as much or as little refrigerant may be used as desired with minimal impact to the main liquefaction process. In this particular embodiment, the warm vapor stream 464 providing heat duty to the stab-in reboiler 458 is cooled and condensed or partially condensed before combining with other streams, as described earlier, prior to routing to the low-stage methane flash drum 94 via conduit D. Or in other embodiments, the cooled, condensed or partially condensed stream in conduit 466 may be routed directly to the low-stage methane flash drum 94, as described earlier. In this particular embodiment, an expansion valve 458A is provided on reboiler tube-side outlet stream 458. One of ordinary skill in the art will recognize that different valving and equipment configurations for reboiler duty control and condensate removal may be utilized (e.g., a valve to adjust the flow of warm vapor on the tube-side inlet of the stab-in reboiler 458 and/or a condensate pot with level control on the tube-side outlet of stab-in reboiler 458). In this particular embodiment, a single valve 458A is illustrated on the tube-side outlet of stab-in reboiler 458. The bottom liquid stream from the third nitrogen column 416 is pumped via pump 474A on level control via level control valve 474 to indirect heating pass 470 in the multipass heat exchanger 434. In some embodiments, pump 474A may be optional, depending on various factors, including but not limited to the desired separation objectives of the third nitrogen column 416 and the final destination pressure within the main liquefaction process. A small separator (not shown) may be provided to assist in the liquid and vapor distribution through pass 470 of the multi-pass heat exchanger 434.

The second nitrogen column bottom liquid stream in conduit 450 is flashed by a pressure reduction means, illustrated here as valve 452, and the resulting flashed stream in conduit 472 is vaporized or partially vaporized while providing condensing duty for first and second passes (445 and 446 respectively) of the multi-pass heat exchanger 434. The vaporized or partially vaporized third nitrogen column bottom stream (in conduit 408) exiting the fourth pass 470 of the multi-pass heat exchanger 434 is then combined with stream 466 and recycled back to the main liquefaction process via conduit D. In some embodiments, the streams in conduits 434 and 466 may be returned to the main liquefaction process separately, as described earlier.

As shown in FIG. 2, the overhead vapor stream in conduit 460 from the third nitrogen column 416 is routed through a fifth pass 478 of the multi-pass heat exchanger 434 where the stream is superheated and subsequently routed to the main liquefaction process for further superheating in exchangers 87 and 74, as illustrated in FIG. 1 prior to rejecting the nitrogen to atmosphere. In some embodiments, the superheated nitrogen exiting the multi-pass heat exchanger 434 in conduit 410 may be further superheated using indirect heat from other main liquefaction process streams and/or an external heat sources (e.g. methane-rich recycle and/or steam or hot oil). While normal routing of the nitrogen vent is to atmosphere, provisions are typically provided to route the nitrogen vent to a flare system if the methane content exceeds a safe limit to prevent ignition, typically about 5 mol % methane. In some embodiments, the superheated nitrogen vent is routed to an incinerator or thermal oxidizer to remove residual amounts of methane prior to venting to atmosphere. For turndown purposes, some embodiments include provisions to recycle all or a portion of the nitrogen rejection unit vent to the main liquefaction process.

Refluxed Nitrogen Rejection Unit

In order to reduce the nitrogen level down to suitable levels, a nitrogen rejection unit may be used to selectively remove nitrogen from natural gas. The nitrogen rejection unit according to one or more embodiments can reduce methane level in the nitrogen vent stream below about 1%. In certain embodiments, the refluxed nitrogen rejection unit can reduce methane level in the nitrogen vent stream to about 0.1% or at least about one order of magnitude as compared to some conventional methods.

FIGS. 3-4 illustrates at least one embodiment of a refluxed nitrogen removal unit in accordance with the present invention. In the illustrated embodiment, three nitrogen columns (530, 532, and 534) are arranged. A superheated feed stream 546 to the nitrogen compressor 548 originates from the final NRU column overhead 534. Temperature of the superheated feed can range from about 15° C. to about 50° C. at pressures between about 150 kPa (1.5 Bara) to about 300 kPa (3.0 Bara).

A portion of the overhead stream 536 is sent as feed stream 538 to the nitrogen compressor 548. The stream 538 is first routed through a plate fin exchanger 542 where the stream 538 is superheated against a nitrogen compressor discharge stream 550. The resulting superheated feed stream 546 is predominately nitrogen but may also contain hydrogen, helium, argon, and methane. Once the superheated feed stream 546 passes through the nitrogen compressor 548, the resulting compressor discharge effluent 554 is cooled in the discharge cooler 552 and subsequently chilled against the feed stream 544 in the plate fin exchanger 542. The chilled stream 556 is then fully condensed and passed through a core-in-shell exchanger 500. The core-in-shell exchanger 500 utilizes methane refrigerant 520 from the main LNG process. The methane refrigerant may be from an open or closed loop refrigeration cycle. The methane refrigerant stage used determines the refrigerant temperature and therefore the nitrogen compressor discharge pressure. Typically, as the temperature of refrigerants decreases, the pressure of the nitrogen compressor discharge decreases. The specific methane refrigeration stage selected may depend on factors such as, but not limited to, overall process efficiency and available power for each stage.

The nitrogen compressor 548 is cascaded with an open or a closed loop methane refrigeration system. The methane refrigerant is flashed into the shell side of the core-in-shell exchanger 500 and vaporized into stream 521*a* which is subsequently routed to flash drum 94 to provide condensing duty required to condense the nitrogen compressor discharge stream 556. When utilizing an open loop methane refrigeration system, the refrigerant source is typically not a pure component. Thus, a small liquid purge stream 521*b* originating from the core-in-shell exchanger 500 is returned to the methane refrigeration system to limit the buildup of heavier components over time, which can negatively impact refrigerant boiling temperature. The purge stream may be controlled in a continuous or batch basis depending on the concentration of components heavier than methane.

The condensed compressor discharge stream 560 is routed back through the plate fin exchanger 542 and further chilled against the feed stream 544 before flashing into the final NRU column reflux drum 562. Liquid from the reflux drum is routed to the final NRU column 534 through conduit 564 as reflux using a flow controller. The pressure of the reflux drum 562 is controlled by the overhead vapor stream 568. For example, the pressure can be adjusted as high as necessary to allow the overhead vapor stream 568 to combine with a portion of last NRU column overhead stream 570. The combined stream 571 is then superheated by routing through plate fin exchanger 540, which is heat integrated with other NRU process streams. At this point, the superheated nitrogen stream contains very little methane and can be vented to atmosphere or routed for further processing to recover helium and/or argon as needed.

Optionally, a portion of the liquid stream from the final NRU column reflux drum 562 may be routed through 572 in order to control the temperature of the final NRU column top feed, which can improve the last NRU column as well as the overall NRU stability.

DEFINITIONS

As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan.

As used herein, the term "open-cycle cascade refrigeration process" refers to a cascade refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles.

As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the terms "upstream" and "downstream" shall be used to describe the relative positions of various components of a natural gas liquefaction plant along the flow path of natural gas through the plant.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 7,234,322

The invention claimed is:

1. A method of removing nitrogen from a natural gas stream comprising:

(a) routing the natural gas stream from a methane cold box of a main liquefaction process to a nitrogen rejection unit comprising: a first distillation column, a second distillation column, a third distillation column, and a condenser, wherein the main liquefaction process comprises: one or more refrigeration cycles external to the nitrogen rejection unit;

(b) at least partially condensing the natural gas stream via the condenser, wherein the condenser utilizes a refrigerant used to transfer heat in the one or more refrigeration cycles to form a condensed natural gas stream, wherein the refrigerant is taken from the refrigeration cycle routed into a core-in-shell exchanger forming the condenser and returned to the refrigeration cycle without passing through the first distillation column; and (c) routing at least a portion of the condensed natural gas stream to the third distillation column to separate the at least a portion of the condensed natural gas stream into a third top fraction and a third bottom fraction, wherein the third top fraction comprises a predominantly nitrogen gas stream.

2. The method of claim 1, wherein the natural gas stream from the methane cold box in step (a) is a predominantly methane gas stream.

3. The method of claim 1, further comprising: routing the third bottom fraction to the main liquefaction process.

4. The method of claim 1, wherein the nitrogen rejection unit further comprises one or more reboilers, each reboiler providing heating duty to the first distillation column, the second distillation column, the third distillation column, or any combination thereof.

5. The method of claim 1, wherein heating duty to the first distillation column, the second distillation column, or the third distillation column is provided by stripping gas or heating gas.

6. The method of claim 1, wherein the refrigerant is selected from the group consisting of: methane, ethylene, propane, any mixture thereof, and any combination thereof.

7. The method of claim 1 further comprising: cooling the natural gas stream to produce a liquefied natural gas stream.

8. The method of claim 1 further comprising expanding the refrigerant prior to being routed into the core-in-shell exchanger.

* * * * *